US007934453B2

(12) United States Patent
Moore

(10) Patent No.: US 7,934,453 B2
(45) Date of Patent: May 3, 2011

(54) EXPLOSIVES INITIATOR, AND A SYSTEM AND METHOD FOR TRACKING IDENTIFIABLE INITIATORS

(75) Inventor: John Vincent Moore, Lathlain (AU)

(73) Assignee: Global Tracking Solutions Pty Ltd (AU)

( * ) Notice: Subject to any disclaimer, the term of this patent is extended or adjusted under 35 U.S.C. 154(b) by 284 days.

(21) Appl. No.: 11/916,246

(22) PCT Filed: Jun. 2, 2006

(86) PCT No.: PCT/AU2006/000766

§ 371 (c)(1),
(2), (4) Date: Nov. 18, 2008

(87) PCT Pub. No.: WO2006/128257

PCT Pub. Date: Dec. 7, 2006

(65) Prior Publication Data

US 2009/0193992 A1 Aug. 6, 2009

(30) Foreign Application Priority Data

Jun. 2, 2005 (AU) ..... 2005902851

(51) Int. Cl.
*F42C 19/00* (2006.01)
*F42C 11/00* (2006.01)

(52) U.S. Cl. ..... 102/293; 102/202.14

(58) Field of Classification Search ..... 102/206, 102/217, 200, 293, 202.5, 202.12, 202.14
See application file for complete search history.

(56) References Cited

U.S. PATENT DOCUMENTS

| | | | | |
|---|---|---|---|---|
| 4,674,047 | A | 6/1987 | Tyler et al. | |
| 5,894,103 | A * | 4/1999 | Shann | 102/215 |
| 6,082,264 | A * | 7/2000 | Meyer et al. | 102/202.9 |
| 6,085,659 | A * | 7/2000 | Beukes et al. | 102/206 |
| 6,892,643 | B2 | 5/2005 | Jennings, III | |
| 7,103,510 | B2 * | 9/2006 | Moolman et al. | 702/187 |
| 7,277,015 | B1 * | 10/2007 | Morhard et al. | 340/572.1 |
| 2004/0045470 | A1 * | 3/2004 | Aebi et al. | 102/301 |
| 2005/0131655 | A1 * | 6/2005 | Moolman et al. | 702/187 |
| 2005/0178282 | A1 * | 8/2005 | Brooks et al. | 102/202.7 |
| 2007/0008115 | A1 * | 1/2007 | Morhard et al. | 340/539.13 |
| 2007/0188325 | A1 | 8/2007 | Morhard et al. | |
| 2007/0188330 | A1 * | 8/2007 | Morhard et al. | 340/572.8 |
| 2007/0229283 | A1 | 10/2007 | Morhard et al. | |
| 2007/0268135 | A1 * | 11/2007 | Morhard et al. | 340/572.1 |
| 2008/0041261 | A1 * | 2/2008 | Hummel et al. | 102/262 |

FOREIGN PATENT DOCUMENTS

| | | |
|---|---|---|
| CN | 2143764 | 10/1993 |
| CN | 1598475 | 3/2005 |

* cited by examiner

*Primary Examiner* — James S Bergin
(74) *Attorney, Agent, or Firm* — Fulbright & Jaworski LLP

(57) ABSTRACT

There is provided an explosives initiator with one or more identification means, and a system and method for tracking identifiable initiators. In the preferred embodiment the identification means is an RFID. A first identification means is disposed internally of the initiator and a second identification means disposed externally of the initiator. Advantageously, if the second identification means is removed from the initiator, the initiator may still be identified by the internally disposed first identification means.

8 Claims, 1 Drawing Sheet

EXPLOSIVES INITIATOR, AND A SYSTEM AND METHOD FOR TRACKING IDENTIFIABLE INITIATORS

CROSS-REFERENCE TO RELATED APPLICATIONS

This application is a national stage application of PCT patent application No. PCT/AU2006/000766, filed Jun. 2, 2006, which claims priority to Australian patent application number 2005902851, filed Jun. 2, 2005.

FIELD OF THE INVENTION

The present invention relates to an explosives initiator, in particular an explosives initiator provided with one or more identification means, and a system and method for tracking identifiable initiators.

BACKGROUND OF THE INVENTION

Explosive materials and the detonators and igniters used to initiate the explosive materials are widely used in the civil and construction industry, military use, the oil and gas industry, mining and quarry use, and demolition.

Although millions of detonators and igniters are distributed and used every year for the purpose of initiating explosive materials, inventory management of the movement of these initiators from the source of origin, to the mine site and thence to the site magazine, is predominantly reliant on manual recordal of information at each distribution point.

For example, upon manufacture the initiators are typically packaged in bags, and then boxed. Both the bags and the box are provided with a bar code sticker recording, amongst other things, the batch number, the box number, the date of manufacture, the total weight and number of initiators included in the bag and/or box. The boxes of initiators are then transported to a destination and tracked only by a bar code system which is reliant on manual recordal of information at the point of manufacture, distribution and destination.

When the boxes of initiators arrive at a particular mine site, the detonators are booked into a site magazine. The total number of initiators is logged into the site magazine upon arrival, as is their withdrawal from the site magazine for blasting operations.

The above system not only relies on timely recordal of the number of initiators withdrawn from the site magazine, but also on the accuracy, honesty and integrity of the persons recording said information. If the initiators are misplaced or stolen, the above system provides little assistance in tracking the whereabouts of the missing initiators. Furthermore, if an unaccounted for initiator is retrieved, there is no way of precisely determining its provenance.

The present invention seeks to overcome at least some of the aforementioned disadvantages.

It is to be understood that, although prior art use and publications may be referred to herein, such reference does not constitute an admission that any of these form a part of the common general knowledge in the art, in Australia or any other country.

SUMMARY OF THE INVENTION

In accordance with a first aspect of the invention there is provided an identifiable initiator for explosives comprising an initiator provided with one or more identification means. The one or more identification means express an identity which is unique to the initiator.

The term "initiator" as used herein refers to a device used for initiating explosives, and encompasses detonators which initiate explosives by a shockwave and igniters which initiate explosives with a flame or a flash. In one embodiment of the invention the initiator is a non-electric initiator, an electric initiator, an electronic initiator, an exploding bridge wire initiator, or a slapper detonator. Suitable examples of non-electric initiators include, but are not limited to, flame or spark initiators, friction-initiated devices, stab initiators, chemical initiators, and percussion initiators.

The initiator comprises an initiator casing, an explosive composition confined within the initiator casing, and a firing signal receptor for receiving a firing signal and conveying said firing signal to initiate the explosive composition. The explosive composition of the initiator is selected in accordance with the type of initiation process required to ignite or detonate the main explosives charge.

In one embodiment of the invention the identification means is disposed internally of the initiator casing. In an alternative embodiment of the invention the identification means is disposed externally of the initiator casing. In a further embodiment of the invention the identification means is in communication with the firing signal receptor.

In one embodiment of the invention, the identification means is a machine-readable wireless device. Suitable examples of machine-readable wireless devices include, but are not limited, to radio frequency signaling devices such as radio frequency identification tags (commonly referred to as RFIDs), magnetic bar codes, and magnetic induction identification tags.

In an alternative embodiment of the invention, the identification means is a machine-readable-and-writable wireless device. It is envisaged that additional information corresponding to the identity of the initiator, the location of the initiator at or after point of manufacture, or the receipt of a firing signal to the firing signal receptor and other information concerning the subsequent blasting event may be written to the machine-readable- and writable wireless device at predetermined times to record the provenance of the initiator from point of manufacture until use.

In a further embodiment of the invention a first identification means is disposed internally of the initiator casing and a second identification means disposed externally of the initiator casing. Advantageously, if the second identification means is removed from the initiator casing, the initiator may still be identified by the first identification means. Typically, the first and second identification means are identical and unique to the initiator.

In one embodiment of the invention, the identification means and/or a portion of the initiator casing to which the identification means is coupled is blast-proof and withstands destruction of the initiator in a blasting event.

In another feature of the invention there is provided a method of tracking an identifiable initiator comprising:

- providing an initiator with one or more identification means having a identity unique to the initiator;
- prior to dispatch of the initiator, recording and storing the unique identity of the initiator as retrievable data in a database;
- after dispatch of the initiator, reading the one or more identification means of the initiator to determine the unique identity of the initiator;
- retrieving data from the database; and, matching the unique identity of the initiator to the retrieved data.

In one embodiment, the method further comprises the step of recording and storing information corresponding to the transfer of the initiator from a first dispatch point to a second dispatch point on the one or more identification means and as retrievable data in the database. In this way, the movement of the initiator from the first dispatch point to the second dispatch point can be tracked.

In another embodiment, the method further comprises the step of recording and storing additional information corresponding to receipt of a firing signal by the initiator and information concerning a subsequent blasting event on the one or more identification means.

In another feature of the invention there is provided a system for tracking an identifiable initiator comprising:

an initiator provided with one or more identification means expressing an identity unique to the initiator;

a means for recording and storing the unique identity of the initiator as retrievable data in a database;

a means for reading the one or more identification means of the initiator to determine the unique identity of the initiator; and a means for retrieving data from the database and matching the unique identity of the initiator to the retrieved data.

In the description and the claims of the invention, except where the context requires otherwise due to express language or necessary implication, the words "comprise" or variations such as "comprises" or "comprising" are used in an inclusive sense, i.e. to specify the presence of the stated features, but not to preclude the presence or addition of further features in various embodiments of the invention.

BRIEF DESCRIPTION OF THE DRAWINGS

Preferred embodiments, incorporating all aspects of the invention, will now be described by way of example only with reference to the accompanying drawings, in which.

DETAILED DESCRIPTION OF THE PREFERRED EMBODIMENTS OF THE INVENTION

Before the preferred embodiment of the present apparatus is described, it is understood that this invention is not limited to the particular materials described, as these may vary. It is also to be understood that the terminology used herein is for the purpose of describing the particular embodiment only, and is not intended to limit the scope of the present invention in any way. It must be noted that as used herein, the singular forms "a", "an", and "the" include plural reference unless the context clearly dictates otherwise. Unless defined otherwise, all technical and scientific terms used herein have the same meanings as commonly understood by one of ordinary skill in the art to which this invention belongs.

Figure 1:
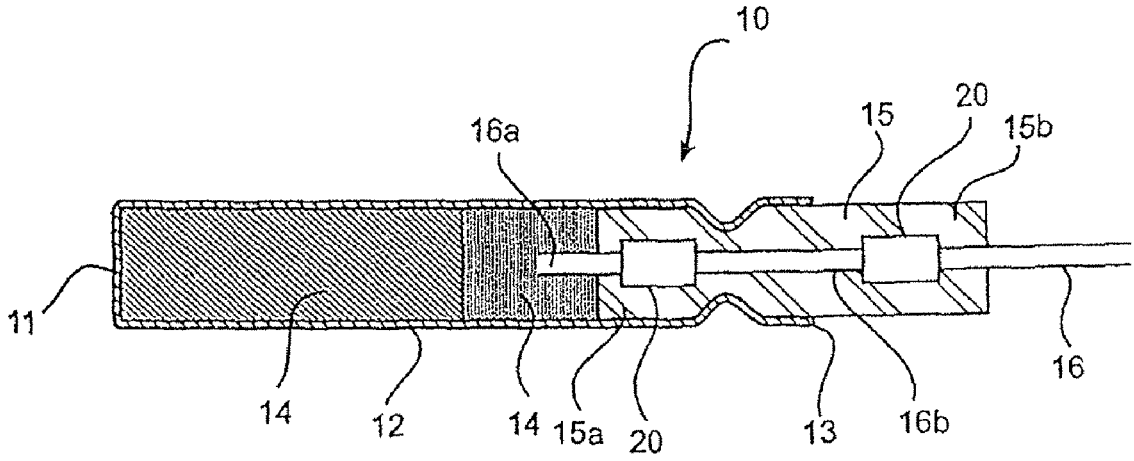
FIG. 1 shows a diagrammatic view of an initiator in accordance with the present invention; and, FIG. 2 shows a schematic representation of a tracking system for the initiators of the present invention.

Referring to FIG. 1, there is provided an identifiable initiator 10 for explosives. The terms "explosive" or "explosive material" as used herein refers to a solid, gas, or liquid material which, when initiated, will release a great amount of heat and pressure by way of a very rapid, self-sustaining exothermic decomposition. There are two principal classes of explosives: (1) deflagrating explosives, whose burning processes are rather slow and are characterized by progressive reaction rates and buildup of pressure that create a heaving action; and (2) detonating explosives, which are characterized by very rapid chemical reactions, thus causing tremendously high pressure and brisance (shattering action).

The initiator 10 can be a non-electric initiator, an electric initiator, an electronic initiator, an exploding bridge wire initiator, or a slapper detonator. Suitable examples of non-electric initiators include, but are not limited to, flame or spark initiators, friction-initiated devices, stab initiators, chemical initiators, and percussion initiators.

The initiator 10 of one embodiment of the present invention includes an initiator casing 12, an explosive composition 14 confined within the initiator casing 12, and a firing signal receptor 16 for receiving a firing signal and conveying said firing signal to initiate the explosive composition.

In the particular embodiment shown in FIG. 1, the initiator casing 12 is an elongate hollow cylinder with a closed end 11 and an open end 13, formed from a metal or metal alloy, such as copper, aluminium, gilding metal, or steel, in particular extrudable steel alloys. It is envisaged that the initiator casing 12 can also be formed from other rigid materials such as plastics materials, medium density fibre materials (MDF), cardboard, and wood.

The explosive composition 14 of the initiator 10 is confined in the initiator casing 12, typically proximal the closed end 11 of the initiator casing 12. The explosive composition 14 is selected in accordance with the type of initiation process required to ignite or detonate the main explosives charge of the blasting event.

The firing signal receptor 16 is concentrically disposed in the initiator casing 12 proximal the open end 13 and adjacent the explosive composition 14 so that the received firing signal can be conveyed to initiate the explosive composition 14. The firing signal receptor 16 is selected in accordance with the type of initiator 10 and will be well known to those skilled in the art. For example, the firing signal receptor 16 for a flame or spark initiator is typically a safety fuse, detonation cord, shock tube, optic fibres, or a length of NONEL™ tubing. The term "NONEL" as used herein refers to non-electric initiating devices, otherwise known as shock tube systems. The term "detonation cord" as used herein refers to a flexible cord containing a centre core of high explosives, which when detonated, will have sufficient strength to detonate other explosives with which it is in contact. The term "safety fuse" as used herein refers to a flexible cord containing a centre core of cordite/black powder and when initiated, will burn with sufficient heat and strength to detonate other explosives with which it is in contact.

Depending on the type of firing signal receptor 16 selected and the dimensions of the initiator casing 12, it is not uncommon for the firing signal receptor 16 to be secured within the initiator casing 12 by inserting the firing signal receptor 16 into a seal 15 configured to receive the firing signal receptor 16. Typically, a portion of the seal 15*a* and the firing signal receptor 16*a* are disposed internally in the initiator casing 12 and a remaining portion of the seal 15*b* and the firing signal receptor 16*b* are disposed externally of the open end 13. In the embodiment shown in FIG. 1 the open end 13 of the initiator casing 12 is tightly crimped over the seal 15 to prevent the contents from being removed from the initiator casing 12 and to seal the contents from contamination with moisture, grease, and dust.

The initiator 10 is provided with one or more identification means 20. The one or more identification means express an identity which is unique to the initiator 10.

The identification means 20 can be disposed internally and/or externally of the initiator casing 12. Preferably, in use, the identification means 20 is in communication with the firing signal receptor.

In the embodiment shown in FIG. 1, the initiator 10 is provided with a first identification means 20 disposed internally within the initiator casing 12 embedded in the first portion of the seal 15*a*, and a second identification means 20' is embedded in the second portion of the seal 15*b* located externally of the initiator casing 12. The first and second identification means 20, 20' can be mounted on, or embedded in the respective portions of the seal 15*a*, 15*b*. Preferably, the first and second identification means 20, 20' are positioned to be in communication with the firing signal receptor 16. The first and second identification means 20, 20' are identical and unique to the initiator 10.

Advantageously, if the portion of the seal 15*b* disposed externally of the initiator casing 12 is removed from the initiator casing 12, or damaged, the initiator 10 may still be identified by the first identification means 20 disposed within the initiator casing 12. It is envisaged that under some circumstances the initiator casing 12 may first have to be opened in order to access the first identification means 20, in which case the initiator 10 may not be used further.

Alternatively, the identification means 20 can be mounted on, or embedded in the outer or inner surface of the initiator casing 12. For example, the identification means 20 can be conveniently mounted on the outer or inner surface of the closed end 11 of the initiator casing 12. In another arrangement, the identification means 20 can be disposed adjacent a delay element or an explosive element within the initiator casing 12.

In one embodiment of the invention, the identification means 20 is a machine-readable wireless device. Suitable examples of machine-readable wireless devices include, but are not limited, to radio frequency signaling devices such as radio frequency identification tags (commonly referred to as RFIDs), magnetic bar codes, and magnetic induction identification tags. In the preferred embodiment, the first and second identification means 20, 20' are RFIDs.

Suitable examples of such RFIDs are 13.56 MHz 64 bit read only closed coupling transponders. The RFIDs may also be donut-shaped, having a diameter corresponding to an internal diameter of the initiator casing 12 for ease of fit therein.

The first and second identification means 20, 20' emit a signal corresponding to a plurality of characters, symbols, or other indicia. The signals are identical and unique to a specific initiator 10. For example, the signal could correspond to 15 characters wherein the first two characters denote a country of origin code, the second two characters denote a manufacturer's code, the third two characters denote a year of manufacture, and the remaining nine characters denote any one of 999,999,999 numerical combinations, for example: AUHE05123456789 to identify that the specific detonator 10 was manufactured in Australia by the Helidon plant in 2005 and provided with the specific numerical combination of 123456789.

Alternatively, the identification means 20 can be a machine-readable-and-writable wireless device. It is envisaged that additional information corresponding to the identity of the initiator 10, the location of the initiator 10 at or after point of manufacture, or the receipt of a firing signal by the firing signal receptor 16 and other information concerning the subsequent blasting event may be written to the machine-readable- and writable wireless device at pre-determined times to record the provenance of the initiator 10 from point of manufacture until use.

In some embodiments of the invention, the identification means 20, the seal 15 and/or a portion of the initiator casing 12 to which the identification means 20 is mounted one or embedded in is blast-proof and withstands destruction of the initiator 10 in a blasting event.

Figure 2:
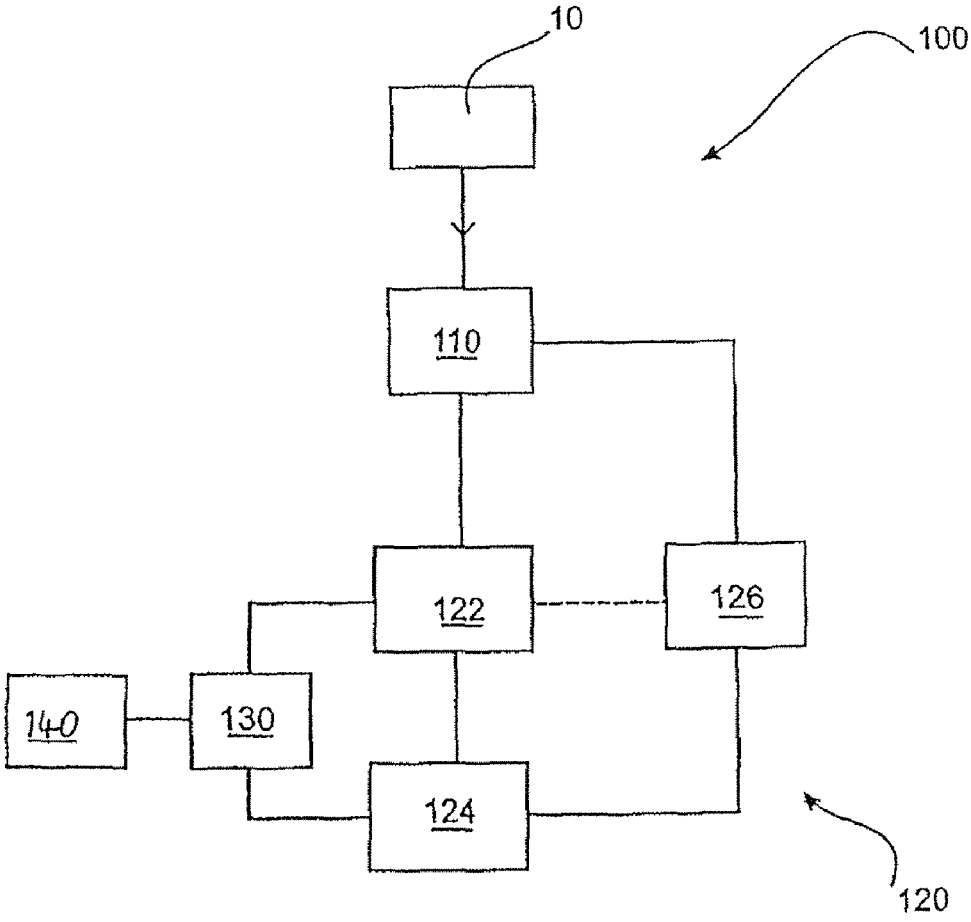

FIG. 2 is a schematic representation of a system 100 for tracking the identifiable initiator 10 of the present invention. The system 100 includes the initiator 10 provided with one or more identification means 20 expressing an identity unique to the initiator 10 as described above, a means 110 for reading the one or more identification means 20 of the initiator 10 to determine the unique identity of the initiator 10, and a means 120 for recording and storing the unique identity of the initiator as retrievable data in a database 130. Preferably the system 100 further comprises a means 140 for retrieving data from the database 130 and matching the unique identity of the initiator 10 to the retrieved data.

The means 110 for reading the one or more identification means 20 of the initiator 10 will be chosen to correspond to the type of machine-readable wireless device used as the identification means 20. For example, when the identification means 20 are RFIDs, the means 110 for reading the identification means 20 will be an RFID reader, or when the identification means 20 are magnetic bar codes, the means 110 for reading the identification means 20 will be a bar code scanner.

Depending on the type of identification means 20 used in the initiator 10, the identification means 20 may need to be physically scanned by the means 110 for reading the identification means 20 of the initiator 10, or, in embodiments of the invention where the identification means 20 are RFIDs, the signals emitted by the RFIDs may be automatically transmitted to and received by the means 110 within a given distance.

The means 110 for reading the identification means 20 of the initiator 10 is in communication with the means 120 for recording and storing the unique identity of the initiator as retrievable data in a database 130. The means 120 for recording and storing the unique identity of the initiator 10 typically comprises at least one logger, and more preferably a slave logger 122 in communication with a master logger 124.

Typically, the slave logger 122 receives and records data from the means 110 for reading the identification means 20 of the initiator 10. In addition to the specific identity of the initiator 10, the slave logger 122 can also record additional information associated with the provenance and movement of the initiator 10, including but not limited to data relating to entry of the initiator 10 in a magazine such as the data entry date, data entry time, identity of person entering the data, magazine location, type of initiator 10, date and time of withdrawal of the initiator 10 from the magazine, replenishment of the magazine with a plurality of initiators 10, etc. The specific identity of the initiator 10 and the additional information may be recorded and stored on an internal hard drive of the slave logger 122 and in a data transfer file format as a the database 130. It is envisaged that the internal hard drive will be of a type akin to an internal black box which cannot be removed from the slave logger 122 unless it is brought back to the manufacturer.

Furthermore, it is envisaged that when the identification means 20 of the initiator 10 are machine readable-and-writable devices, the additional information associated with the provenance and movement of the initiator 10, as described above, can also be written and stored on the machine readable-and-writable devices. For example, transmittal and receipt of a firing signal at the firing signal receptor 16 of the initiator 10 may also be simultaneously recorded and stored by the slave logger 122 and the identification means 20 of the initiator 10.

The data stored on the slave logger 122 may be transferred to the master logger 124 at regular intervals, typically, daily, weekly or monthly intervals. It is envisaged that a USB Pro-Drive can also be used to transfer data from the slave logger 122 to the master logger 124 in case of a system and/or network failure.

The slave logger 122 may be further provided with a servant logger 126, to which data is automatically directed from the means 110 for reading the identification means 20 of the initiator 10, if the slave logger 122 is disabled in any way.

It will be understood that the system 100 is also provided with a computer program or operating software which facilitates ready retrieval of data stored in the database 130 and comparison thereof with data obtained by the means 110 for reading the identification means 20 of the initiator 10 in order to provide a positive identification of the initiator 10 of the present invention.

One mode of practice of the invention comprises providing the initiator 10 of the present invention with a unique identity at the point of manufacture by embedding or mounting one or more identification means 20, such as RFIDs, internally and/or externally of the initiator casing 12. The RFIDs emit an identical coded signal which is unique to the initiator 10.

Prior to dispatch of the initiator 10, the coded signal of the RFIDs is read by the means 110 for reading the identification means 20 of the initiator 10 and is recorded by the slave logger 122 and stored as retrievable data in a database 130.

At any time after dispatch of the initiator 10, the identity of the initiator 10 can be determined by reading the signal emitted by the identification means 20 with the means 110 for reading the identification means 20, and comparing the data so obtained with data retrieved from the database 130.

Information corresponding to the transfer of the initiator 10 from a first dispatch point to a second dispatch point can also be recorded and stored on the one or more identification means 20 and as retrievable data in the database 130. In this way, the movement of the initiator 10 from the first dispatch point to the second dispatch point can be tracked.

Furthermore, additional information corresponding to receipt of a firing signal by the firing signal receptor 16 of the initiator 10, and optionally information concerning a subsequent blasting event, can also be recorded and stored on the one or more identification means 10.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description.

The invention claimed is:

1. An initiator comprising
an initiator casing,
an explosive composition confined within the initiator casing,
and a firing signal receptor for receiving a firing signal and conveying said firing signal to initiate the explosive composition,
wherein the initiator is provided with a first identification means disposed internally of the initiator casing and a second identification means disposed externally of the casing, and
wherein the first and second identification means are identical and unique to the initiator.

2. The initiator according to claim 1, wherein the first and/or second identification means is in communication with the firing signal receptor.

3. The initiator according to claim 1, wherein the first and second identification means comprises a machine-readable wireless device.

4. The initiator according to claim 3, wherein the machine-readable wireless device comprises radio frequency signaling devices, magnetic bar codes, or magnetic induction identification tags.

5. The initiator according to claim 1, wherein the first and second identification means is a machine-readable-and-writable wireless device.

6. The initiator according to claim 1, wherein the initiator is selected from a group comprising non-electric initiator, electric initiator, electronic initiator, exploding bridge wire initiator, slapper detonator.

7. The initiator according to claim 6, wherein the non-electric initiator is selected from a group comprising flame or spark initiators, friction-initiated devices, stab initiators, chemical initiator, and percussion initiators.

8. The initiator according to claim 1, wherein the first and second identification means and/or a portion of the initiator casing to which the first and second identification means is coupled is blast-proof and withstands destruction of the initiator in a blasting event.

* * * * *